US012044244B2

(12) United States Patent
Mason et al.

(10) Patent No.: US 12,044,244 B2
(45) Date of Patent: Jul. 23, 2024

(54) CEILING FAN BLADE AND GROMMET

(71) Applicant: Hunter Fan Company, Memphis, TN (US)

(72) Inventors: Douglas Troy Mason, Horn Lake, MS (US); Bobby Neal Norwood, Oakland, TN (US)

(73) Assignee: Hunter Fan Company, Memphis, TN (US)

( * ) Notice: Subject to any disclaimer, the term of this patent is extended or adjusted under 35 U.S.C. 154(b) by 0 days.

(21) Appl. No.: 18/343,059

(22) Filed: Jun. 28, 2023

(65) Prior Publication Data

US 2023/0340961 A1 Oct. 26, 2023

Related U.S. Application Data

(63) Continuation of application No. 17/112,250, filed on Dec. 4, 2020, now Pat. No. 11,732,724.

(60) Provisional application No. 62/952,763, filed on Dec. 23, 2019.

(51) Int. Cl.
*F04D 25/08* (2006.01)
*F04D 29/34* (2006.01)
*F04D 29/64* (2006.01)

(52) U.S. Cl.
CPC ..... *F04D 25/088* (2013.01); *F04D 29/34* (2013.01); *F04D 29/646* (2013.01)

(58) Field of Classification Search
CPC ..... F04D 25/088; F04D 29/34; F04D 29/646
USPC ..... 416/210 R
See application file for complete search history.

(56) References Cited

U.S. PATENT DOCUMENTS 546,432 A * 9/1895 Prust et al. ..... F27B 7/00 432/171
965,105 A * 7/1910 Greenwald et al. .... B24B 27/00 451/435
3,091,795 A * 6/1963 Budwig ..... F16L 5/027 439/550
3,622,249 A * 11/1971 Hayashi ..... F04D 29/329 416/241 A
4,511,310 A * 4/1985 Pearce ..... F04D 29/646 416/204 R
5,069,586 A * 12/1991 Casey ..... F16B 5/01 411/908
5,304,037 A * 4/1994 Scofield ..... F04D 29/34 416/214 R
5,464,320 A * 11/1995 Finney ..... F03D 1/04 415/60
5,464,323 A * 11/1995 Scofield ..... F04D 25/088 29/889
5,811,728 A * 9/1998 Maeda ..... H02G 3/083 174/152 G (Continued)

*Primary Examiner* — Kurt Philip Liethen
*Assistant Examiner* — John D Bailey
(74) *Attorney, Agent, or Firm* — McGarry Bair PC

(57) ABSTRACT

A ceiling fan or ceiling fan assembly can include a motor to rotatably drive a set of fan blades. The set of fan blades are attached to the motor via a blade iron, which mounts the blades to a rotating rotor of the motor. A grommet is provided within holes of the blades, between the blade and a fastener, to reduce vibration and improve dampening at the junction between the blades and the motor. Multiple flanges are formed at the end of each grommet. The multiple flanges provide for improved compressibility to improve ease of installation, which resisting sliding of the grommet from the holes in the blades.

14 Claims, 6 Drawing Sheets

(56) References Cited

U.S. PATENT DOCUMENTS 5,899,663 A * 5/1999 Feder ..... F04D 29/34 416/5
5,951,197 A * 9/1999 Wu ..... F04D 29/34 403/329
5,980,353 A * 11/1999 Wu ..... F04D 25/088 416/207
6,039,540 A * 3/2000 Wu ..... F04D 25/088 416/207
6,045,112 A * 4/2000 Kirkwood ..... H02K 5/24 310/91
6,099,527 A * 8/2000 Hochschuler ..... A61B 17/82 606/279
6,206,640 B1 * 3/2001 Andulics ..... B63H 1/20 416/178
6,210,117 B1 * 4/2001 Bucher ..... F04D 29/34 416/210 R
6,220,818 B1 * 4/2001 Andulics ..... F04D 29/283 416/178
6,309,183 B1 * 10/2001 Bucher ..... F04D 29/34 416/207
6,328,513 B1 * 12/2001 Niwa ..... F16F 1/362 411/339
6,352,411 B1 * 3/2002 Bucher ..... F04D 29/34 403/302
6,382,917 B1 * 5/2002 Zuege ..... F04D 25/088 416/210 R
6,585,488 B1 * 7/2003 Bucher ..... F04D 25/088 416/244 R
6,666,652 B2 12/2003 Bucher et al.
6,768,058 B2 * 7/2004 Pallapothu ..... B60R 16/0222 174/151
6,821,091 B2 * 11/2004 Lee ..... F04D 29/34 416/207
6,872,053 B2 3/2005 Bucher et al.
7,223,078 B1 * 5/2007 Mares ..... F04D 29/34 416/214 R
7,771,172 B2 * 8/2010 Wang ..... F04D 29/34 416/207
7,775,771 B2 * 8/2010 Wang ..... F04D 25/088 416/207
7,927,076 B1 * 4/2011 Bucher ..... F04D 25/088 416/207
8,604,362 B2 * 12/2013 Hsu ..... H02G 3/083 16/2.2
8,690,161 B2 * 4/2014 Cayzac ..... F16L 5/10 277/606
8,727,732 B2 5/2014 Webb et al.
8,845,293 B1 * 9/2014 Lowe ..... F04D 25/088 416/205
9,273,707 B2 * 3/2016 Lee ..... A44B 13/0076
9,482,242 B1 * 11/2016 Mares ..... F04D 29/322
9,523,369 B2 * 12/2016 Wang ..... F04D 25/088
9,651,058 B1 * 5/2017 Mares ..... F04D 29/34
11,160,333 B2 * 11/2021 Yu ..... A44B 13/0064
2001/0046442 A1 * 11/2001 Bucher ..... F04D 25/088 416/210 R
2002/0182076 A1 * 12/2002 Bucher ..... F04D 29/34 416/220 A
2003/0099545 A1 * 5/2003 Liang ..... F04D 29/34 416/206
2005/0093387 A1 * 5/2005 Chen ..... F04D 29/646 310/91
2009/0035143 A1 * 2/2009 Wang ..... F04D 29/34 416/220 R
2009/0123287 A1 * 5/2009 Wang ..... F04D 29/646 416/210 R
2009/0246028 A1 * 10/2009 Richardson ..... F04D 29/34 416/210 R
2011/0116946 A1 * 5/2011 Webb ..... F04D 29/34 416/210 R
2011/0158812 A1 * 6/2011 Lu ..... F04D 29/34 416/210 R
2015/0233385 A1 * 8/2015 Wang ..... F04D 29/34 416/62
2016/0327058 A1 * 11/2016 Tyler ..... F01P 5/06
2019/0360497 A1 * 11/2019 Guo ..... F04D 25/088

* cited by examiner

CEILING FAN BLADE AND GROMMET

CROSS-REFERENCE TO RELATED MATTERS

This application is a continuation of U.S. patent application Ser. No. 17/112,250, filed Dec. 4, 2020, which claims priority to and the benefit of U.S. Provisional Patent Application No. 62/952,763, filed on Dec. 23, 2019, which is incorporated herein by reference in its entirety.

FIELD OF INVENTION

This disclosure relates to the field of ceiling fans, and more specifically, to vibration dampening in ceiling fans. The disclosure is directed to a grommet utilized in a ceiling fan blade to dampen vibrations, as well as a design for the grommet that improves ease of installation.

BACKGROUND OF THE INVENTION

Ceiling fans often include a set of blades rotatably coupled to a motor assembly to rotate the set of blades. Rotation of the set of blades drives a volume of fluid, typically ambient air within a room, space, or area. Ceiling fan blades include a traditional aesthetic, commonly having a flat bottom on the blade which provides consumers with a traditional ceiling fan style and look.

Traditional style blades can use a grommet element when coupling the blade to the blade iron to dampen any vibration at the connection, reducing the instance of noise or blade imbalance. However, these grommets include an annular lip at either end to secure the grommet within the mounting hole on the blade. As blade shapes change in order to improve efficiency, blade thickness and geometry changes as well, requiring larger or longer grommets. These larger or longer grommets are often difficult for the user to install due to the annular lip, as compression of the grommet for installation can be challenging.

BRIEF DESCRIPTION OF THE INVENTION

In one aspect, the disclosure relates to a ceiling fan assembly comprising: a motor including a rotor rotatably driven by the motor; a blade including a top surface and a bottom surface, with a mount hole extending between the top surface and the bottom surface; a blade iron connecting the blade to the rotor; and a grommet provided in the mount hole and including a first end and a second end, with a set of flanges including multiple discrete flanges extending from at least one of the first end or the second end.

In another aspect, the disclosure relates to a grommet for a ceiling fan blade, the grommet comprising: a cylindrical body extending between a first end and a second end, the cylindrical body including an exterior surface and an interior surface, with the interior surface defining an interior extending between the first end and the second end; and a set of flanges including multiple discrete flanges extending radially from the first end, relative to the cylindrical body.

In yet another aspect, the disclosure relates to a method of installing a ceiling fan with a grommet having a first end and a second end, with multiple discrete flanges extending from the first end and the second end, the method comprising: inserting a grommet into a mount hole of a ceiling fan blade, until the multiple discrete flanges at the first end abut a first surface of the blade and the multiple discrete flanges at the second end abut a second surface of the blade.

DETAILED DESCRIPTION OF EMBODIMENTS

Figure 1:
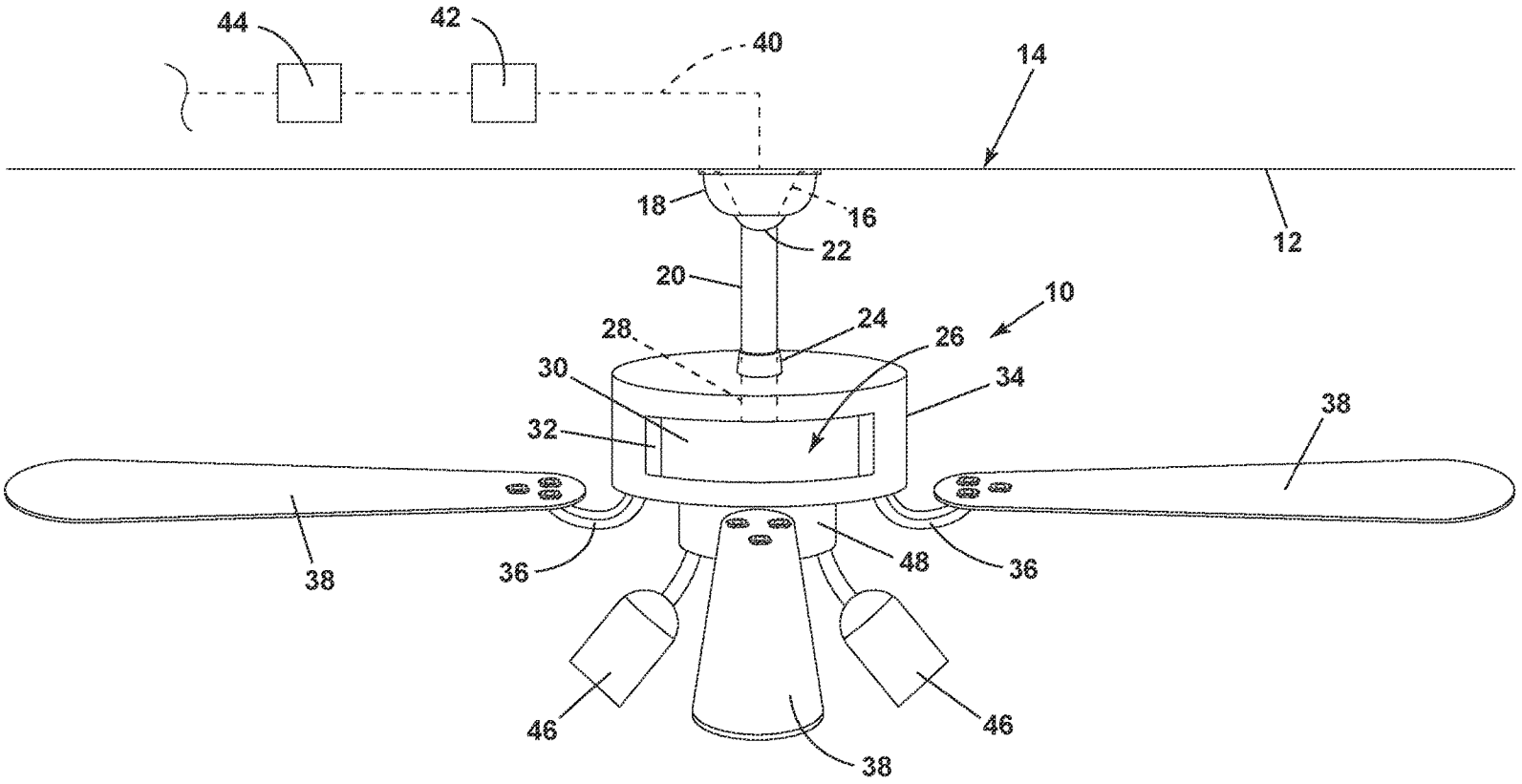
FIG. 1 is a partial schematic view of a ceiling fan having a set of blades suspended from a structure.

The disclosure provided herein relates to blades for a ceiling fan, and more specifically, to a grommet used with ceiling fan blades where the blades mount to a blade iron. This disclosure also relates to the use of a grommet at the mechanical connection between a ceiling fan blade and a ceiling fan blade iron that dampens vibration from the blades as well as provides for simplified user installation of the grommet, as well as the blades and blade irons, providing for an improved overall installation experience.

All directional references (e.g., radial, axial, proximal, distal, upper, lower, upward, downward, left, right, lateral, front, back, top, bottom, above, below, vertical, horizontal, clockwise, counterclockwise, upstream, downstream, forward, aft, etc.) are only used for identification purposes to aid the reader's understanding of the present disclosure, and do not create limitations, particularly as to the position, orientation, or use of aspects of the disclosure described herein. Connection references (e.g., attached, coupled, connected, and joined) are to be construed broadly and can include intermediate members between a collection of elements and relative movement between elements unless otherwise indicated. As such, connection references do not necessarily infer that two elements are directly connected and in fixed relation to one another. The exemplary drawings are for purposes of illustration only and the dimensions, positions, order and relative sizes reflected in the drawings attached hereto can vary. As used herein, the term "set" or a "set" of elements can be any number of elements, including only one. For example, a set of grommets or a set of blades as used herein can include one or more grommets, or one or more blades.

Referring to FIG. 1, an exemplary ceiling fan 10 is mounted to a ceiling 12 of a structure 14, such as in a residential home. Alternatively, the ceiling fan 10 can be mounted or suspended in a myriad of environments, such as on a ceiling or wall, in a residential space or home, outdoor or indoor, in an industrial setting, such as a manufacturing plant, or in an agricultural setting, in non-limiting examples.

The ceiling fan 10 includes a mount 16 suspending the ceiling fan 10 from and coupling the ceiling fan 10 to the ceiling 12. A canopy 18 covers the mount 16. A downrod 20 is suspended from the mount 16 by a ball 22. A motor adapter 24 secure the downrod 20 to a motor 26 via a motor shaft 28 extending from the motor 26. The motor 26 can include a stator 30 mounted to the motor shaft 28, as well as a rotor 32 rotatably driven about the stator 30. The motor adapter 24 can further couple to a motor housing 34 at least partially encasing the motor 26. A set of blade irons 36 couples a complementary set of blades 38 to the rotor 32 for rotating the blades 38 and driving a volume of fluid, such as air, about the structure 14 or a local room therein. A switch housing 48 can mount below the motor housing 34 and electrically couple to the motor 26. A light kit 46 can electrically and mechanically couple to the switch housing 48.

It should be understood that the ceiling fan 10 as depicted in FIG. 1 is by way of example only, and it should be understood that more or less components than those shown and described can be included with the ceiling fan 10, and such variation among ceiling fan assemblies is within the scope of this description.

The ceiling fan 10 can be coupled to a power supply 40, such as a building electrical supply. The power supply 40 may be connected to one or more controllers 42 or switches 44. The controllers 42 can be used to receive or send information related to the control and operation of the ceiling fan 10, such as over a wired or wireless signal. The switches 44, can be operated to control the ceiling fan 10, such as a wall-mounted switch, for example. While the controller 42 and the switch 44 are schematically shown exterior of the ceiling 12, it should be appreciated that the controller 42 and the switch 44 may be optional, or may be provided in other positions, such as on the wall or ceiling, or within portions of the ceiling fan 10 itself.

Figure 2:
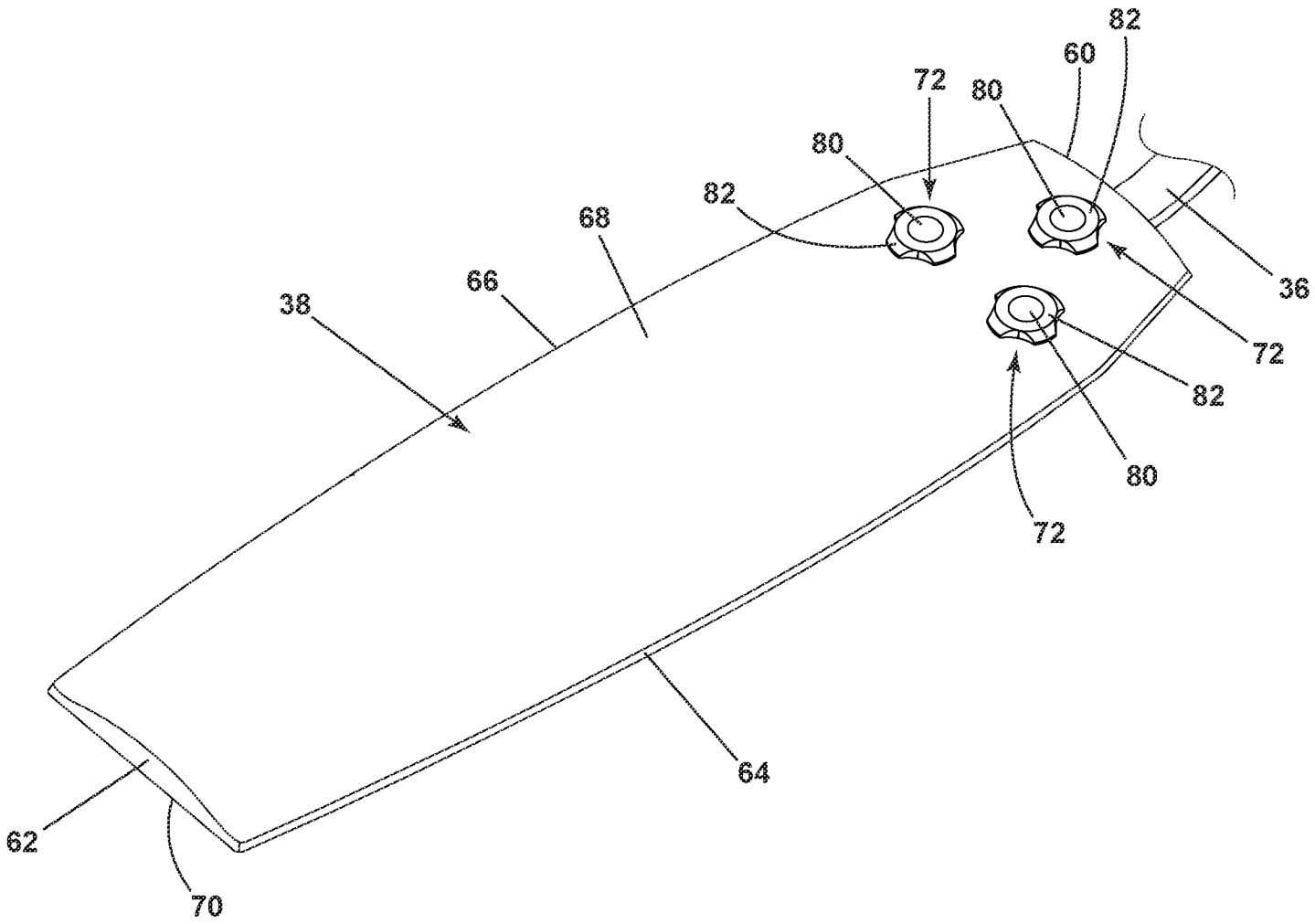
FIG. 2 is a perspective view of one ceiling fan blade of the set of blades of FIG. 1, with the blade including a set of grommets.

Turning to FIG. 2, the blade 38 can extend between a root 60 and a tip 62, defining a spanwise direction therebetween. The blade 38 can further include a first edge 64 and a second edge 66, defining a chordwise direction therebetween. In one example, the first edge 64 can be a leading edge and the second edge 66 can be a trailing edge, while the particular orientation may be dependent on the rotational direction of the ceiling fan. Additionally, the blade 38 can include a top surface 68 and a bottom surface 70, defining a thickness for the blade between the top surface 68 and the bottom surface 70. In one non-limiting example, the bottom surface 70 can be flat, while the top surface 68 can be curved or arcuate, thereby defining an airfoil cross-sectional profile for at least a portion of the blade 38. As is appreciable, the top surface 68 includes a convex curvature, defining an increased thickness nearer to the chordwise center of the blade 38, as compared to the thickness at the edges 64, 66. It should also be appreciated that the thickness need not be at the chordwise center, but can vary between the first and second edges 64, 66, such that the thickest portion may be nearer to one of the first edge 64 or the second edge 66, as opposed to the chordwise center. The blade 38 can further include a set of fastener openings 72, shown with a grommet 82 provided in each opening 72.

The blade 38 can couple to the blade iron 36 by a set of fasteners 80, which can pass through the set of fastener openings 72 and the grommets 82. The set of grommets 82 can be included with the set of fasteners 80, such that one grommet 82 of the set of grommets 82 can be paired with one fastener 80 of the set of fasteners 80. Thus, the number of fasteners 80 can be complementary to the number of grommets 82. The grommets 82 can be provided between the fasteners 80 and the body of the blade 38, while positioned within the set of fastener openings 72. Additionally, it is contemplated that at least a portion of the grommets 82 can be provided between the blade 38 and the blade iron 36, to reduce or minimize vibration at the junction between the blade 38 and the blade iron 36, along with reducing or minimizing damage or stress to the blade 38 resultant from lengthy use of the ceiling fan. The grommets 82 can be made of a rubber, plastic, or polymeric material, in non-limiting examples. Preferably, the grommets 82 are made of a material that is wear resistant, while providing for dampening any vibrational forces at the junction between the blade 38 and the blade iron 36. One example material can include polyether ether ketone (PEEK), while any suitable material may be utilized.

Figure 3:
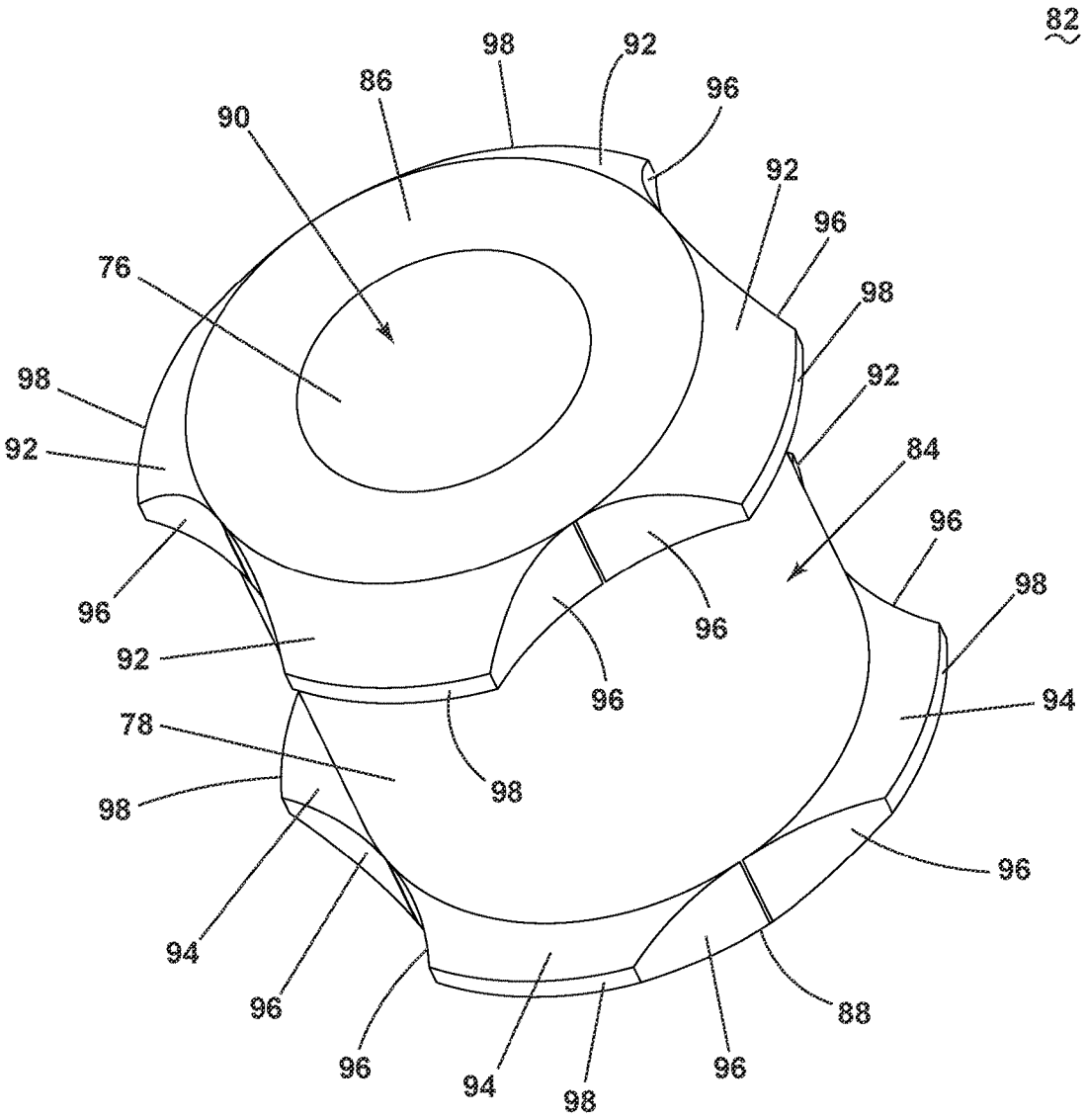
FIG. 3 is a perspective view of one grommet of the set of grommets of FIG. 2.

Referring to FIG. 3, the grommet 82 includes a body 84 extending between a first end 86 and a second end 88. The body 84 can be substantially cylindrical, having an interior 90 extending between the first end 86 and the second end 88, defining an interior surface 76 and an exterior surface 78. The grommet 82 can further include a first set of flanges 92 at the first end 86 and a second set of flanges 94 at the second end 88. As shown, each set of flanges 92, 94 can include four flanges, while any suitable number of flanges is contemplated, such as between two and six flanges, while more than six flanges is contemplated. Each flange 92, 94 of the set of flanges can be spaced from adjacent flanges by 90-degrees, relative to the cylindrical body 84. Each flange 92, 94 can be similarly shaped, with each flange 92, 94 including a pair of concave curved sidewalls 96, arranged on either side of a convex end wall 98, with concave and convex being with reference to the viewing perspective. Each concave curved sidewall 96 terminates at the exterior of the cylindrical body 84, and then continuously transitions (or with a small gap therebetween, as shown) to another curved sidewall 96 for the adjacent flange 92, 94. However, it should be appreciated that it is contemplated that the flanges 92, 94 need not be shaped as shown, but can be any suitable shape such that the flanges 92, 94 extend beyond the width of the cylindrical body 84 or the exterior surface 78 thereof. The flanges 92, 94 can each include a flat bottom surface 100, configured to rest against the top or bottom surfaces 68, 70 of the blade 38 (see FIG. 2).

Figure 4:
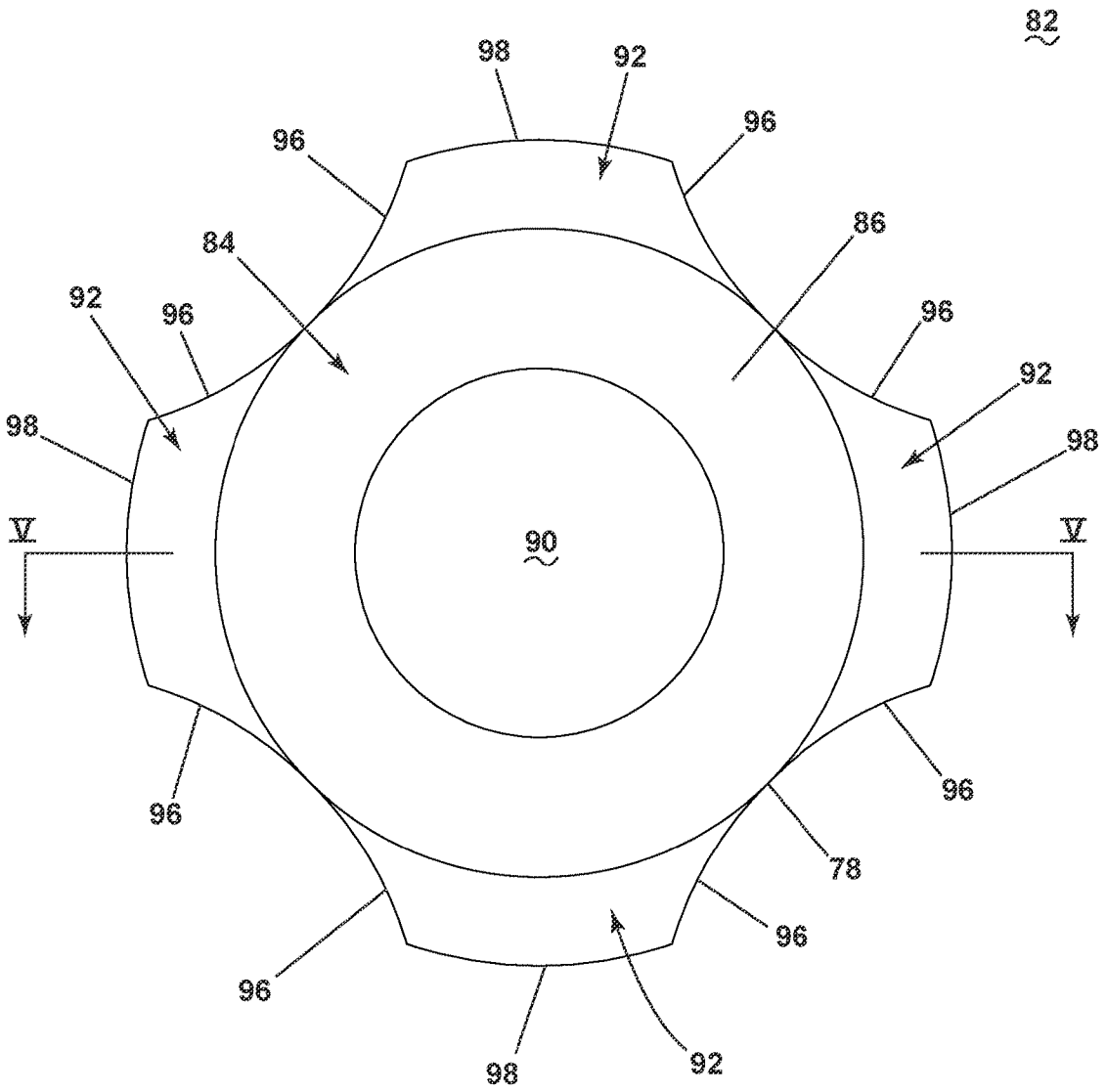
FIG. 4 is a top-down view of the grommet of FIG. 3.

Referring briefly to FIG. 4, the top-down view of the first end 86 of the grommet 82 better shows the concave curvature for the sidewalls 96, as well as the slight convex curvature of the end walls 98. As can be appreciated, the curvature between the sidewalls 96 of adjacent flanges 92, 94 seamlessly connects, to provide a continuous surface between the adjacent sidewalls 96, which seems to terminate flush with the exterior surface 78 of the body 84 at the junction between two adjacent sidewalls 96.

Figure 5:
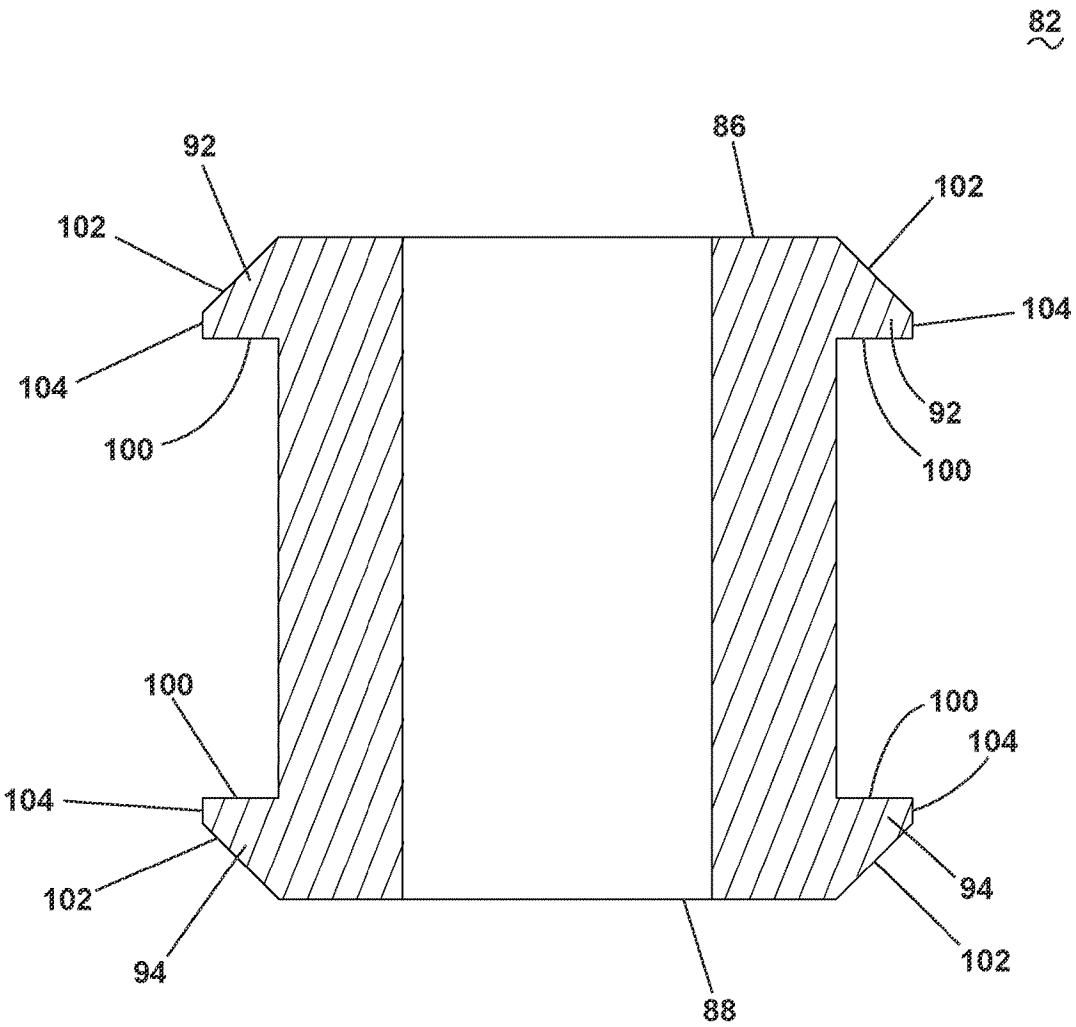
FIG. 5 is a section view of the grommet of FIG. 4, taken across section V-V.

Referring to FIG. 5, a sectional view taken across section V-V of FIG. 4, where a sectional view of the shape of the flanges 92, 94 is appreciable. Namely, the bottom surface 100 can be readily identified, extending radially outwardly from the exterior surface 78, relative to the cylindrical body 84. Additionally, the flanges 92, 94 can be seen as having a beveled surface or an angled surface 102 and an outer surface 104, with the angled surface 102 extending from one of the first and second ends 86, 88 of the body 84 to the outer surface 104. The outer surface 104 then terminates at the bottom surface 100. As shown, the outer surface 104 can be arranged orthogonal to the bottom surface 100, while variation on the specific geometry of the grommet 82 as shown is within the scope of this disclosure, and the particular geometry as shown is by way of example.

The grommets 82 as described herein provide for improved dampening at the fasteners which couple the blade to the blade iron. Traditional grommets have an annular lip, as opposed to the flanges 92, 94 as described herein. The annular lip on other grommets generates a cylinder stress, not only on the grommet body, but also on the annular lip. The cylinder stress is a stress distribution resultant of the rotational symmetry of the grommet as well as with the annular lip for grommets that have an annular lip, and is often referred to as a circumferential stress or a hoop stress, which is defined as a normal stress in the tangential direction, relative to the cylindrical annular lip and the cylindrical body. Thus, it should be appreciated that a grommet 82 using the flanges 92, 94 provides for a reduced hoop stress at the flanges (where other grommets can include the annular lip), which provides for improved compressibility and ease for installing the grommet to a fan blade.

However, a blade that does not have flat top and bottom surfaces requires an increased height for the grommet, resulting in more required material for the grommet. The greater material provides a greater cylinder stress when installing the grommet, which makes installation of the grommet difficult. The flanges 92, 94 provide for improved or increased compressibility of the whole grommet, as compared to a grommet having a full annular lip, which results in a decreased cylinder stress or hoop stress, facilitating and easing installation by the user. This is particularly advantageous with aerodynamically shaped or aerodynamically efficient blades, where larger or longer grommets are required. Such larger or longer grommets are difficult to compress for installation, particularly with an annular lip. Utilizing the grommet with the flanges 92, 94 as described herein reduces the hoop stress to improve compressibility and ease of installation. Additionally, use of the flanges as opposed to an annular lip can provide for reduced overall material as compared with that of a grommet using an annular lip, also decreasing cost of the material. Such an overall reduction in material can even be seen when the grommet 82 is lengthened, as compared to a shorter grommet with an annular lip. In one example, use of the flanges as opposed to annular lips can provide a 6.41% decrease in overall material, while as much as a 10% decrease or more is contemplated.

The use of flanges as described herein provides for improved compressibility of the grommet 82, which provides for easier installation into mount holes of the ceiling fan blade 38 by compressing the grommet 82 and inserting it into the mount holes. Thus, installation becomes easier for the user or installer, as the use of flanges permits easy compression of the grommet and insertion into the holes on the blades. Thus, the grommet as described herein provides for easier installation, decreased material usage, and decreased costs, while still providing all of the benefits of a traditional grommet in such a position.

Figure 6:
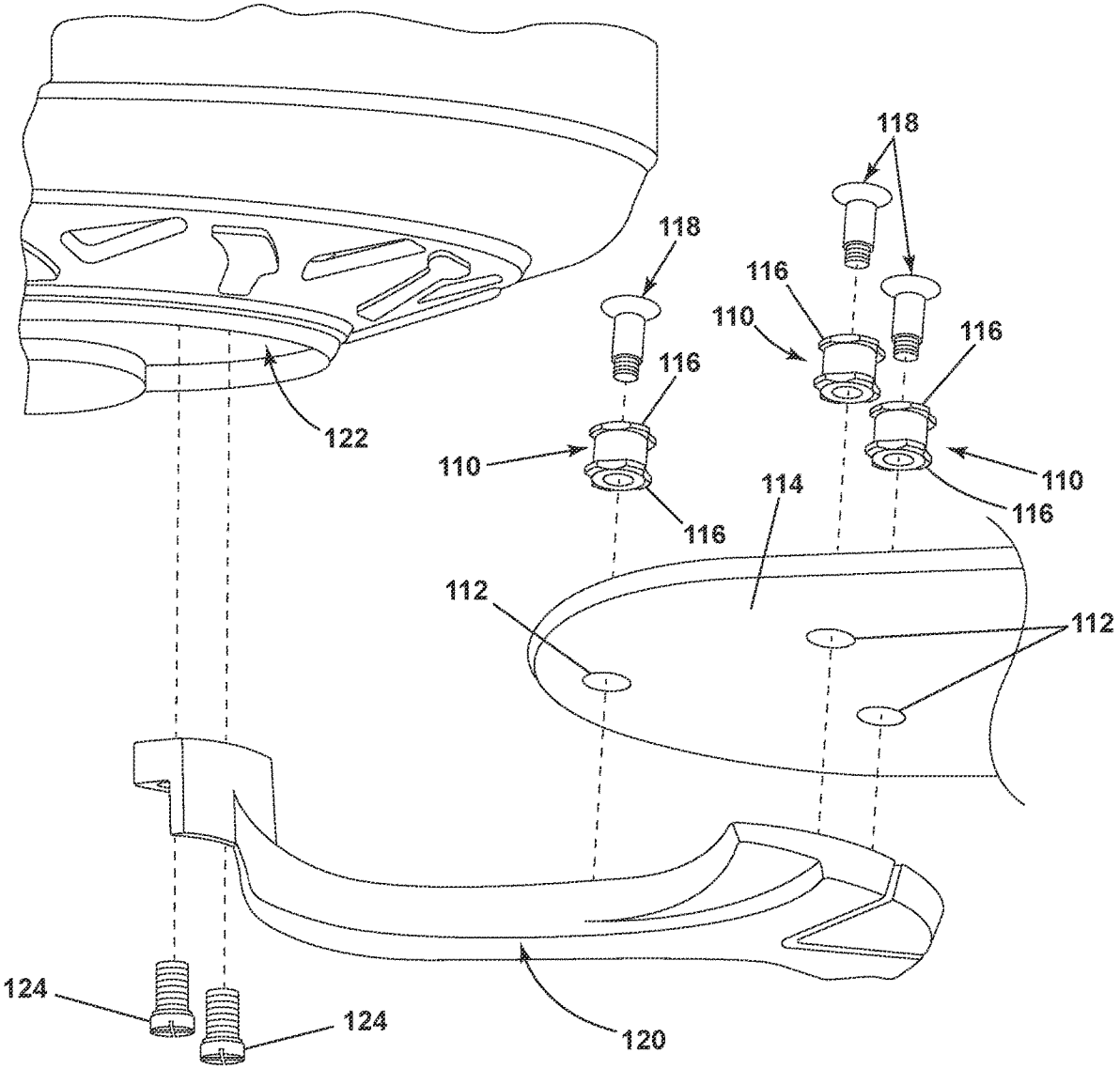
FIG. 6 is an exploded view of a ceiling fan assembly, showing the connection between a motor assembly, a blade iron, a blade, the set of grommets of FIG. 2, and a set of fasteners.

Referring now to FIG. 6, a method of installation can be appreciated. The method can include inserting one or more grommets 110 into mount holes 112 provided in a ceiling fan blade 114. Such insertion can be done by the user or installer on site, while it is contemplated that insertion of the grommet 110 can be done by the manufacturer. Insertion of the grommet 110 can include compressing the grommet 110, such as by the user squeezing the grommet 110 by hand or with a tool, and inserting one end with one set of flanges 116 through the mount hole 112. The flanges 116 provided on the grommets 110 provide for improved or increased compression of the grommets 110 during insertion into the mount holes 112, which facilitates installation. It should be appreciated that the outer diameter of the flanges 116 is greater than that of the diameter of the mount holes 112. Thus, compression of the flanges 116 is required for insertion of the grommet 110 into the mount holes 112. Thus, it should be understood that the flanges 116 provide for securing the grommet against the top and bottom surfaces of the blade 114, while providing for ease of compression during installation, particularly in comparison to that of a grommet that includes a fully annular flange. Additionally, the flanges 116 can provide for a better hold along a curved surface, as opposed to an annular lip.

After the grommets 110 are inserted, one or more fasteners 118 can be inserted through the grommets 110 and can fasten to a blade iron 120 via a threaded connection, for example. The grommets 110 help to dampen the connection between the blade 114 and the blade iron 120, which reduces vibrations and noise, as well as improves operational lifetime.

The blade iron 120 can then be fastened to a rotor 122 via additional fasteners 124, while any suitable connection of the blade iron 120 to the rotor 122 is contemplated, and may vary depending on the particular ceiling fan or blade iron style. Additionally, rotor 122 can be any rotational portion of the motor for the ceiling fan, and need not by a traditional rotor 122 directly driven by a stator, but can be a rotating portion of the motor housing or a mount hub, for example.

It should be appreciated that the method as described herein is non-limiting, and the order as discussed in regards to FIG. 6 can be rearranged in any suitable order. For example, the blade iron 120 can attach to the rotor 122, then attach the blade 114 to the blade iron 120. Thus, it should be appreciated that the order of the method is non-limiting as described, and that the order may be switch or rearranged as desired. However, it is noted that it would be difficult to install the grommet 110 after the fastener 118 has been used to fasten the blade 114 to the blade iron 120.

Additionally, it should be contemplated that a method of installing a ceiling fan with a grommet 82 having a first end 86 and a second end 88, with multiple flanges 92, 94 extending from the first end 86 and the second end 88. The method can include inserting a grommet into a mount hole of a ceiling fan blade, until the flanges at the first end abut a first surface of the blade and the multiple flanges at the second end abut a second surface of the blade. The method can further include wherein inserting the grommet includes compressing the grommet. The method can also further include inserting a fastener through the grommet and coupling the fastener to a blade iron to couple the ceiling fan blade to the ceiling fan. The method can also further include fastening the blade iron to the ceiling fan.

To the extent not already described, the different features and structures of the various aspects can be used in combination, or in substitution with each other as desired. That one feature is not illustrated in all of the examples is not meant to be construed that it cannot be so illustrated, but is done for brevity of description. Thus, the various features of the different aspects can be mixed and matched as desired to form new aspects, whether or not the new aspects are expressly described. All combinations or permutations of features described herein are covered by this disclosure. Therefore, it should be understood that it is contemplated that features of one embodiment may be applied to another embodiment, and interchanged, added, or removed to form additional embodiments not explicitly shown, but still within the scope of the disclosure.

Although the embodiment of the present invention have been shown and described, it would be appreciated by those skilled in the art that changes may be made in these embodiments without departing from the principles and spirit of the invention. Although specific terms are employed herein, they are used in a generic and descriptive sense only and not for purposes of limitation.

What is claimed is:

1. A ceiling fan assembly comprising:

a motor including a rotor;

a blade including a top surface and a bottom surface, with a mount hole extending between the top surface and the bottom surface;

a blade iron connecting the blade to the rotor; and a grommet provided in the mount hole and including a cylindrical body with a first end and a second end, with a first set of flanges including multiple discrete flanges extending laterally from the first end and a second set of flanges including multiple discrete flanges extending from the second end.

2. The ceiling fan assembly of claim 1 wherein each flange of the first and second sets of flanges includes a beveled surface.

3. The ceiling fan assembly of claim 2 wherein each flange of the first and second sets of flanges includes a bottom surface, and the bottom surface of each flange is adapted to abut the blade.

4. The ceiling fan assembly of claim 3 wherein each flange of the first and second sets of flanges includes an outer surface provided between and spacing the beveled surface and the bottom surface.

5. A grommet for a ceiling fan blade, the grommet comprising:

a cylindrical body extending between a first end and a second end, the cylindrical body including an exterior surface and an interior surface, with the interior surface defining an interior extending between the first end and the second end; and a set of flanges including multiple discrete flanges extending only radially from the first end, relative to the cylindrical body, wherein each flange of the set of flanges includes a beveled surface, a bottom surface abutting the blade, and an outer surface provided between and spacing the beveled surface and the bottom surface;

wherein a second set of flanges extend from the second end;

wherein the set of flanges includes four flanges and the second set of flanges includes four flanges, with each flange of each set of four flanges is spaced from adjacent flanges by 90-degrees, relative to the cylindrical body.

6. The grommet of claim 5 wherein each flange of the set of flanges includes two curved sidewalls.

7. The grommet of claim 6 wherein each flange of the set of flanges terminates at an end wall.

8. The grommet of claim 7 wherein each curved sidewall is curved in such a way to be continuous with a curved sidewall of an adjacent flange.

9. The grommet of claim 8 wherein the end wall of each flange is convexly curved, relative to the cylindrical body.

10. The grommet of claim 5 wherein the beveled surface for each flange extends radially outwardly, relative to the cylindrical body, and is angled toward the second end.

11. A ceiling fan assembly comprising:

a motor including a rotor;

a blade including a top surface and a bottom surface, with a mount hole extending between the top surface and the bottom surface;

a blade iron connecting the blade to the rotor; and a grommet provided in the mount hole and including a body extending between a first end and a second end, with a set of flanges including multiple discrete flanges extending from at least one of the first end or the second end;

wherein each flange of the set of flanges includes a beveled surface, a bottom surface abutting the blade, and an outer surface provided between and spacing the beveled surface and the bottom surface;

wherein the outer surface comprises a pair of sidewalls and a tip, with the sidewalls extending from the body and terminating at the tip, and the sidewalls are concave and the tip is convex.

12. The ceiling fan assembly of claim 11 wherein the adjacent sidewalls of adjacent flanges define a continuous concave surface between adjacent tips of the adjacent flanges.

13. The ceiling fan assembly of claim 12 wherein the adjacent sidewalls meet at the body and are flush with the body where they meet at the body.

14. The ceiling fan assembly of claim 13 wherein the adjacent concave sidewalls and convex tips form an alternating pattern of adjacent concave sidewalls and convex tips around the body.

* * * * *